US008931242B1

(12) United States Patent
Sardo

(10) Patent No.: US 8,931,242 B1
(45) Date of Patent: Jan. 13, 2015

(54) STRETCHABLE GIFT WRAP SYSTEM

(76) Inventor: Louis Sardo, Gardena, CA (US)

( * ) Notice: Subject to any disclaimer, the term of this patent is extended or adjusted under 35 U.S.C. 154(b) by 326 days.

(21) Appl. No.: 13/488,727

(22) Filed: Jun. 5, 2012

(51) Int. Cl.
*B65B 51/04* (2006.01)

(52) U.S. Cl.
CPC ..... *B65B 51/04* (2013.01)
USPC ..... 53/417; 383/121; 383/71

(58) Field of Classification Search
CPC ..... B65B 1/043
USPC ..... 53/417, 138.8, 284.7, 137.2, 138.1, 53/139.4, 138.7
See application file for complete search history.

(56) References Cited

U.S. PATENT DOCUMENTS

| | | | | | |
|---|---|---|---|---|---|
| 488,630 | A | | 12/1892 | Hafely | |
| 2,493,063 | A | * | 1/1950 | Frank et al. | 383/71 |
| 3,011,690 | A | * | 12/1961 | Gabuzda | 206/524.1 |
| 3,276,671 | A | * | 10/1966 | Fleitman | 206/521 |
| 3,348,595 | A | * | 10/1967 | Stevens, Jr. | 206/525 |
| 3,357,070 | A | * | 12/1967 | Soloan | 24/562 |
| 3,732,662 | A | * | 5/1973 | Paxton | 53/415 |
| 3,820,200 | A | * | 6/1974 | Myers | 4/30.5 S |
| 4,138,055 | A | * | 2/1979 | Harrison | 232/1 C |
| 4,189,808 | A | * | 2/1980 | Brown | 24/30.5 R |
| 4,201,806 | A | * | 5/1980 | Cole | 428/4 |
| 4,267,995 | A | * | 5/1981 | McMillan | 248/74.1 |
| 4,357,740 | A | * | 11/1982 | Brown | 24/30.5 S |
| 4,570,304 | A | * | 2/1986 | Montreuil et al. | 24/30.5 S |
| 4,644,610 | A | * | 2/1987 | Fish | 24/30.5 S |
| 4,840,822 | A | * | 6/1989 | Cheng | 428/4 |
| 4,914,789 | A | * | 4/1990 | Pedersen | 24/30.5 S |
| 5,004,144 | A | | 4/1991 | Selga | |
| 5,381,588 | A | * | 1/1995 | Nelson | 24/30.5 S |
| 5,392,983 | A | | 2/1995 | Clarke-Bolling et al. | |
| 5,404,621 | A | * | 4/1995 | Heinke | 24/30.5 R |
| 5,456,062 | A | | 10/1995 | Wechsler | |
| 5,495,645 | A | * | 3/1996 | Suzuki et al. | 24/30.5 S |
| 5,513,455 | A | | 5/1996 | Walker | |
| 5,529,395 | A | | 6/1996 | French | |
| 5,618,105 | A | * | 4/1997 | Baker | 366/130 |
| 5,644,799 | A | * | 7/1997 | Armenta et al. | 2/209.13 |
| 5,695,088 | A | * | 12/1997 | Kasbohm | 220/495.11 |
| 5,732,530 | A | * | 3/1998 | Pfaff | 53/403 |
| 5,743,458 | A | | 4/1998 | French | |
| 5,774,041 | A | | 6/1998 | Xydis et al. | |
| 5,934,548 | A | * | 8/1999 | Kenyon | 229/87.19 |
| 5,943,804 | A | * | 8/1999 | Linquist et al. | 40/637 |
| 6,007,403 | A | * | 12/1999 | Urspringer et al. | 446/222 |

(Continued)

FOREIGN PATENT DOCUMENTS

WO WO 2004015193 A1 * 2/2004 ..... D06F 95/00

*Primary Examiner* — Hemant M Desai
*Assistant Examiner* — Eduardo R Ferrero
(74) *Attorney, Agent, or Firm* — Goldstein Law Offices, P.C.

(57) ABSTRACT

A gift wrapping system, for use in wrapping a gift, contained within gift packaging having a top and bottom, using a wrapping device having a main part and a closure plate having a central opening. The main part is made of a highly stretchable material formed into a tube having an open end and a closed end. The gift packaging is inserted into the main part through the open end, and the gift is pushed downwardly toward the closed end as the open end is pulled upwardly. Once the bottom of the gift packaging is against the closed end and the open end is pulled above the top of the gift packaging, the open end above the top is grabbed as a tail, which is pulled upwardly through the central opening of the closure plate as the closure plate is pushed downwardly against the top of the gift packaging.

6 Claims, 14 Drawing Sheets

(56) References Cited

U.S. PATENT DOCUMENTS

| | | | | |
|---|---|---|---|---|
| 6,092,932 | A | 7/2000 | Pekala et al. | |
| 6,161,263 | A * | 12/2000 | Anderson | 24/545 |
| 6,241,389 | B1 | 6/2001 | Gilmore et al. | |
| 6,425,795 | B1 * | 7/2002 | Horsfall et al. | 446/73 |
| 6,472,038 | B1 | 10/2002 | Murphy | |
| 6,591,460 | B1 * | 7/2003 | Hoshino | 24/30.5 S |
| 7,077,308 | B2 | 7/2006 | Beach | |
| 7,093,410 | B2 * | 8/2006 | van Drunen | 53/417 |
| D573,187 | S | 7/2008 | Donat | |
| D612,744 | S | 3/2010 | Childs | |
| 7,926,702 | B2 | 4/2011 | Childs | |
| 8,128,288 | B2 | 3/2012 | Feeney | |
| 8,357,142 | B2 * | 1/2013 | Romero | 604/533 |
| 2002/0136004 | A1 | 9/2002 | Rudoy | |
| 2005/0081488 | A1 * | 4/2005 | Drunen | 53/417 |
| 2007/0041670 | A1 | 2/2007 | Spizman et al. | |
| 2008/0285895 | A1 * | 11/2008 | Murgul | 383/93 |
| 2009/0152332 | A1 * | 6/2009 | Childs | 229/87.19 |
| 2011/0305408 | A1 * | 12/2011 | Gallagher | 383/75 |
| 2012/0012646 | A1 | 1/2012 | Bissonnette | |

* cited by examiner

STRETCHABLE GIFT WRAP SYSTEM

TECHNICAL FIELD

The present disclosure relates generally to a system for easily wrapping a gift prior to presenting it to a recipient. More particularly, the present disclosure relates to a reusable gift wrap structure, that may be stretched over a gift such that it conforms to the shape of the gift and conceals the gift within a substantially opaque covering, and is easily removed and reused by the recipient.

BACKGROUND

Along with the generosity of the act of gift giving, part of the fun experienced by the giver and recipient is the surprise about the gift itself. In particular, the giver enjoys selecting a gift that will surprise the recipient, and the recipient enjoys receiving something they did not expect.

This 'fun of the unknown' aspect of the gifting experience is greatly enhanced through the practice and tradition of wrapping gifts before they are presented to their intended recipients. When someone receives a gift wrapped item, they immediately know they have received a gift of some sort, but their curiosity intensifies as they wonder what might be inside!

Gift wrapping traditionally employs thin sheets of paper having a decorative print, cut to size carefully, folded over the edges of a present, and taped onto itself. The act of gift wrapping is relatively easy, and the average person can achieve reasonably neat results when square or rectangular prism shaped boxes or objects are wrapped. An irregularly shaped gift with non-orthogonal edges, however, can be extremely difficult to neatly wrap.

In recent years, the practice and tradition has been somewhat modified through the use of "gift bags". Gift bags are generally heavy paper bags, not unlike paper grocery store bags, except coated and printed to be attractive or to bear some festive message or decoration. The gift bag itself does not fully conceal the gift, which is visible at the top opening, unless covered by tissue paper or the like. While the gift bag may sometimes be reused, at most it can only be reused a couple of times. Because it is made of paper, gift bags quickly wrinkle, giving them a used appearance. In addition, gift bags require careful handling. Once they are holding gifts, they generally cannot be stacked in the way that wrapped gifts are often stacked for transport, or for placement under a Christmas tree. Gift bags are also easily torn or damaged—giving them a used appearance even when they are only being used for the first time!

While these units may be suitable for the particular purpose employed, or for general use, they would not be as suitable for the purposes of the present invention as disclosed hereafter.

BRIEF SUMMARY

It is the object of the present disclosure to provide a device that can be used to cover/conceal/wrap a gift before presenting it to a recipient. Accordingly a wrapping device is described that fully engulfs the gift and, when handed to the recipient thereby conceals it and its contents to the recipient.

It is another object of the present disclosure to provide a device that can conform to both regular, orthogonal shapes, as well as irregular shapes. Accordingly, the device is preferably made of a stretchable fabric, and thereby stretches to accommodate gifts and gift packaging of nearly any shape.

It is yet a further object of the present disclosure to provide a neatly bound wrapping for the gift. Accordingly, the device has a closed end and a free end. The gift is inserted into the open end and pulled toward the closed end as the fabric stretches around the gift. Once the gift is fully engulfed within the device and pulled fully toward the closed end, the free end is temporarily closed with a closure plate.

It is a still further object of the present disclosure to provide a wrapping system that allow the gift to be easily opened by the recipient. Accordingly, the recipient merely pulls upwardly on the closure plate to remove it from the free end, and then stretches the open end over and off of the wider edges of the gift, and then pulls it off the rest—just like one would remove a sock from a foot, by stretching it slightly and pulling it over and off of the heel and then easily free of the toes.

Generally, what is disclosed herein is a gift wrapping system, for use in wrapping a gift, contained within gift packaging having a top and bottom, using a wrapping device having a main part and a closure plate having a central opening. The main part is made of a highly stretchable material formed into a tube having an open end and a closed end. The gift packaging is inserted into the main part through the open end, and the gift is pushed downwardly toward the closed end as the open end is pulled upwardly. Once the bottom of the gift packaging is against the closed end and the open end is pulled above the top of the gift packaging, the open end above the top is grabbed as a tail, which is pulled upwardly through the central opening of the closure plate as the closure plate is pushed downwardly against the top of the gift packaging.

To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 5:
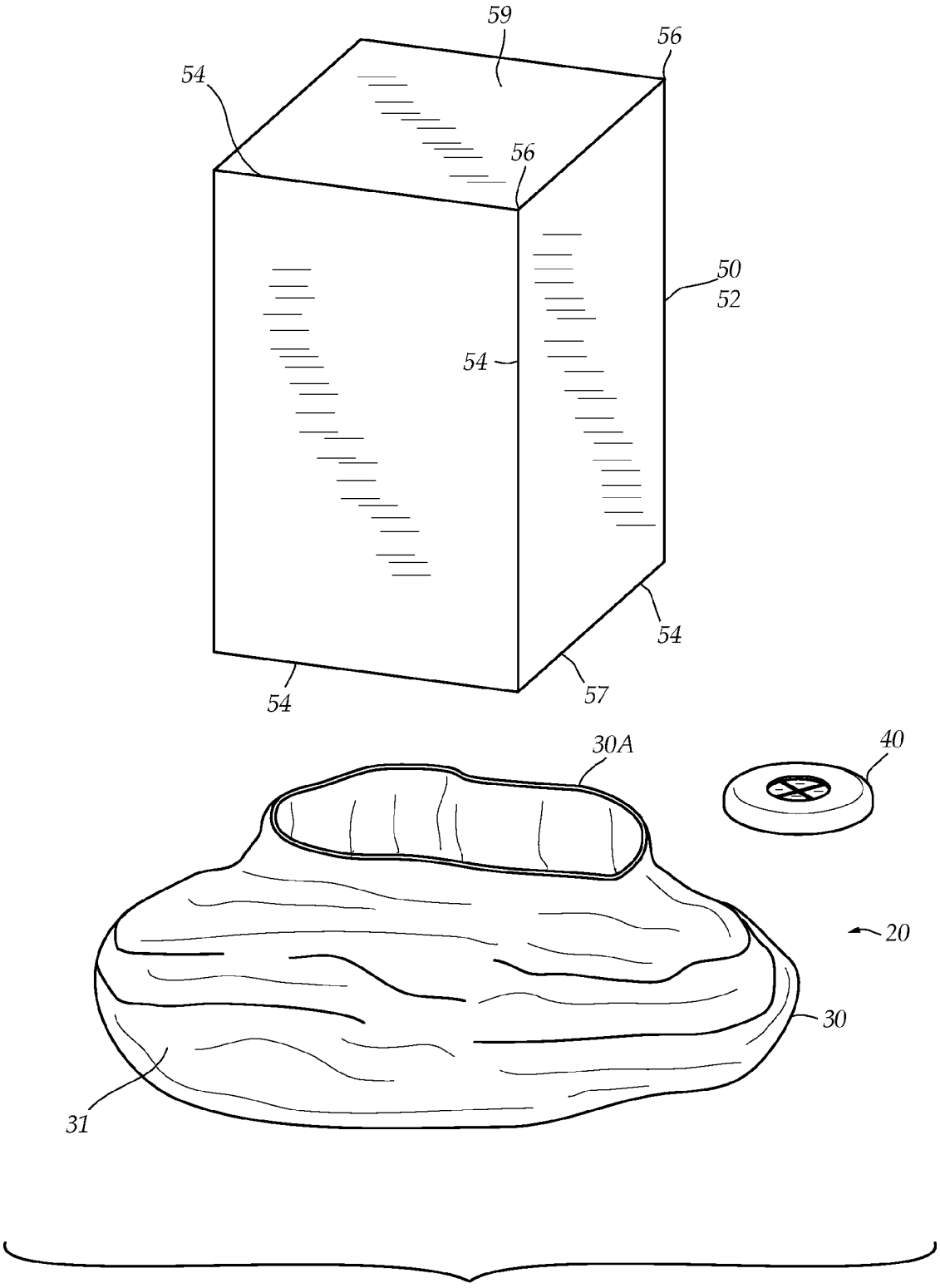
FIG. 5 illustrates a gift, contained within a rectangular prism shaped gift packaging, about to be wrapped using the wrapping device that includes the main part and the closure plate.

FIG. 5 illustrates a gift wrapping device 20, which includes a main part 30, and a closure plate 40. The gift wrapping device 20 is for covering and concealing a gift 50 contained within gift packaging 52. Note that the gift packaging 52 illustrated is in the shape of a rectangular prism, having orthogonal edges 54, and corners 56 where the orthogonal edges 54 meet. Further, for the sake of simplifying the following discussion, it should be noted that this type of shape for the gift packaging 52 may include a broad flat bottom 57, and a broad flat top 59. As will be apparent hereinafter, however, the gift wrapping device 20 is capable of neatly covering and concealing a gift 50 that is contained in gift packaging 52 having virtually any shape—including those having non-orthogonal edges, rounded or spherical surfaces, tapered portions, etc. Accordingly, the main part 30 of the gift wrapping device 20 is made of a highly stretchable, conformable fabric material, most preferably the fabric generally known as SPANDEX or ELASTANE. Accordingly, while many fabrics are somewhat stretchable and may be considered conformable, it is fabrics that have the high stretchability and conformability properties of SPANDEX or ELASTANE that are considered "highly stretchable and conformable" for the purposes of the present disclosure.

Figure 1:
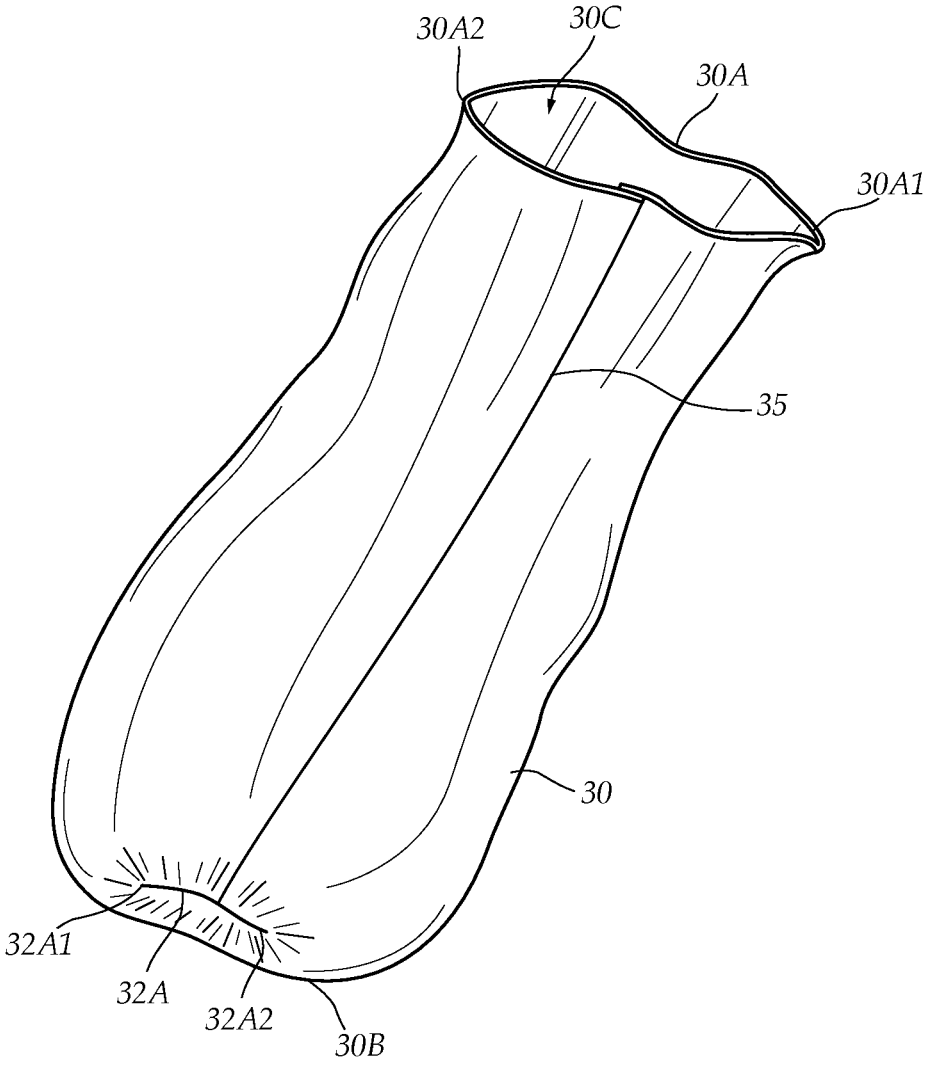
FIG. 1 is diagrammatic perspective view, illustrating the main part of the wrapping device, per se, having an open end, and having a closed end with a straight, shortened gathered stitch.
Figure 2:
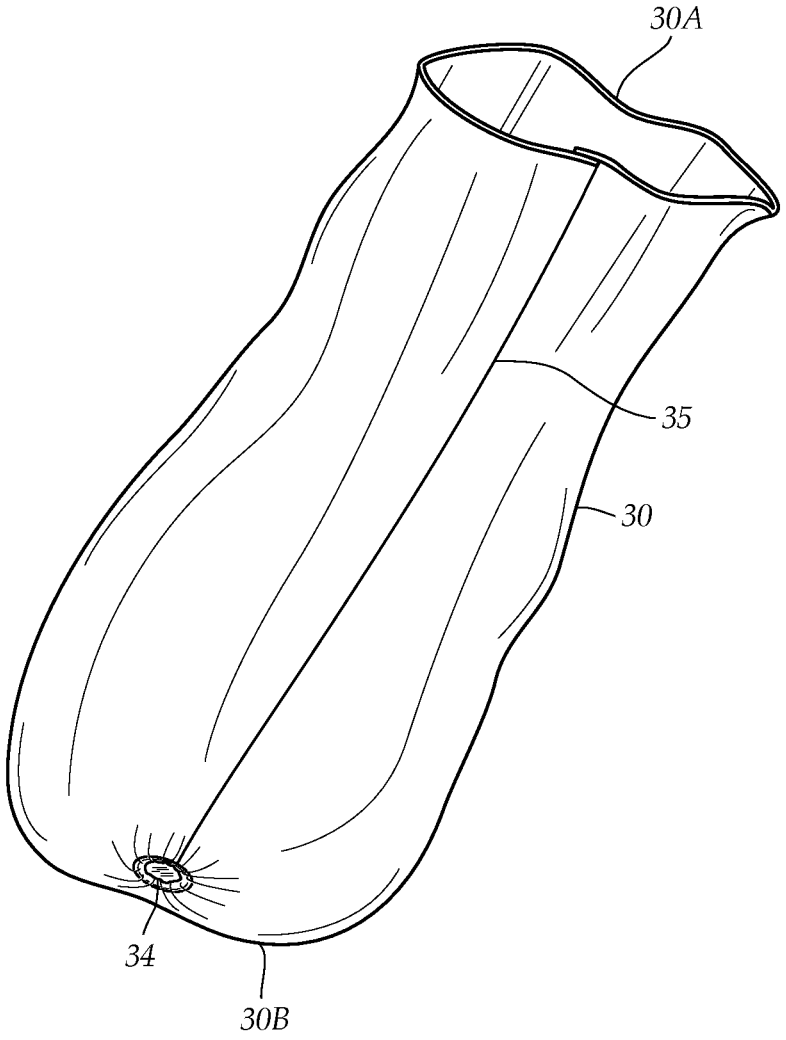
FIG. 2 is a diagrammatic perspective view, similar to FIG. 1, except wherein the closed end has a ring gathered stitch.

Referring generally to FIG. 1 and FIG. 2, the main part 30 of the wrapping device 20 is made from a fabric sheet 31, formed in the general shape of a bag or partially closed tube, having an open end 30A, a closed end 30B, and an interior 30C. As the fabric sheet is stretched, the interior 30C can define an interior volume of varying size. When relaxed as illustrated, however, the interior volume is much smaller than it can become when stretched. Note that in its relaxed stage, the open end 30A has an open end relaxed width. This open end relaxed width can be measured by laying the main part 30 flat and measuring between opposite corners 30A1 and 30A2. It is important to note that while much of the prior art, does not make clear how 'bag like shapes' would actually be constructed from fabric, and instead illustrate them as if they could be magically 'cast' into the shape desired, FIG. 1 and FIG. 2 actually indicate two realistic, yet distinct ways that the main part 30 can be constructed to meet the goals of the present system. In particular, FIG. 1 and FIG. 2 show embodiments with two distinct manners of creating the closed end 30B. In particular, the closed end 30B in FIG. 1 is created by a shortened gathered seam 32A, and in FIG. 2 the closed end 30B is created by a ring gathered seam 34—which will both be described in further detail hereinbelow. Important to note for now, is that the closed end 30B has a closed end relaxed width that is significantly less that the open end relaxed width. Note that the closed end relaxed width is measured between endpoints 32A1 and 32A2 of the shortened gathered seam 32A in the embodiment of FIG. 1, or diametrically across the ring gathered seam 34 in the case of the embodiment of FIG. 2. Note that since the closed end relaxed width is significantly less (at least several times less) that the open end relaxed width, it is of little difference whether we precisely consider a 'diameter', a flattened measurement, or the like. It is also important to note that while providing the shortened gathered seam 32A or the ring gathered seam 34 makes the tube somewhat tapered immediately adjacent to the closed end, it is highly desirable that overall the tube has a consistent size (or relaxed width), and in merely gathered into a smaller size at the closed end, providing a slight tapering immediately adjacent thereto.

Figure 9:
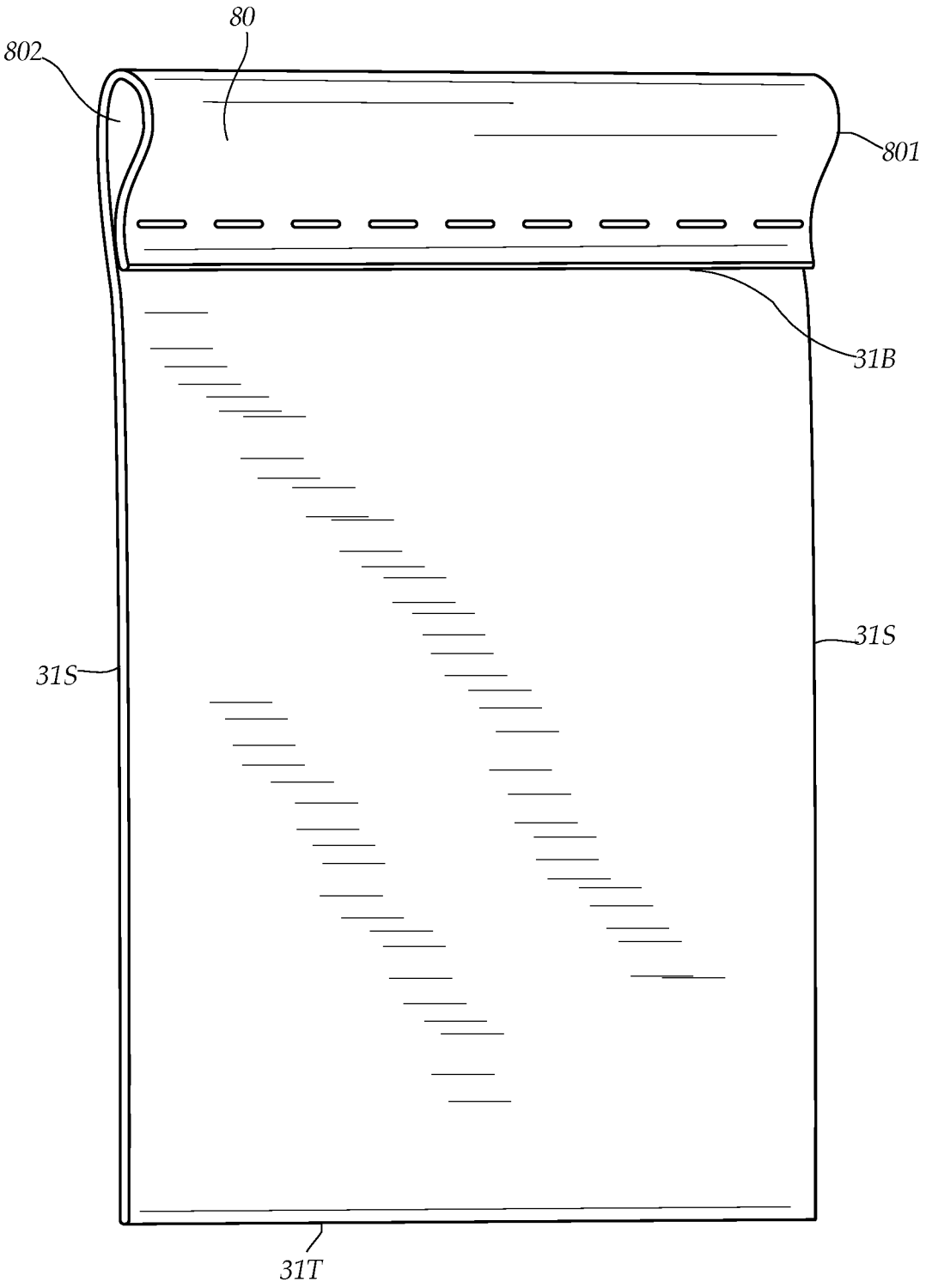
FIG. 9 illustrates a possible step for fabricating the main part of the gift wrapping device to have the ring gathered stitch illustrated in FIG. 2. In particular an edge of a sheet of fabric (shown upside down) is folded over and stitched along its bottom edge, creating a transverse pocket with openings at opposite edges.
Figure 13:
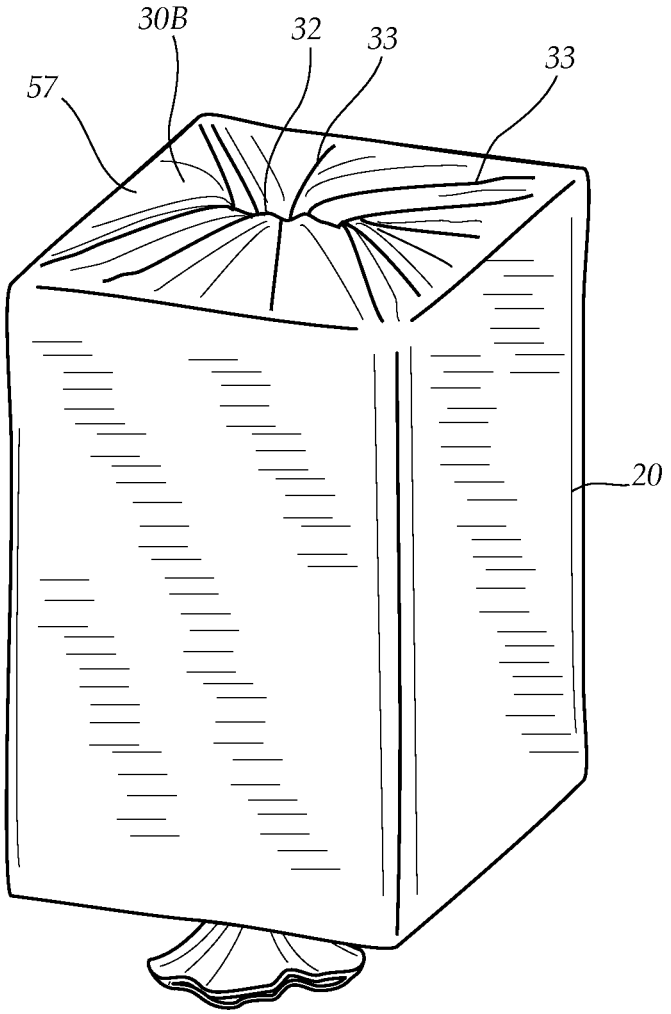
FIG. 13 illustrates the wrapped gift with the straight gathered stitch at the closed end.

In describing fabrication of the main part 30, it is useful to refer now to FIG. 9. In particular, the fabric sheet 31 is substantially rectangular, and is shown in FIG. 9 upside down, having a top edge 31T, a bottom edge 31B, and a pair of side edges 31S. Note that in order to create the embodiments of FIG. 1 and FIG. 2, the side edges 31S are ultimately stitched together along a main seam 35, creating a tube that would at this point be open on both sides. Once again, evenly constructing this tube from a rectangular sheet, this tube would be essentially 'even', having the same relaxed width from end to end. To create a 'bag like structure', it is necessary to close one of the ends. One solution would be to stitch straight across the bottom edge 31B, creating a two-dimensional or flat 'envelope' of sorts, that would be a true rectangle. In reality, however, this solution would create undesirable wrinkles, creases, bunching, buckling and/or gaps, as one sought to insert into the resulting structure a three dimensional object—especially the gift packaging like the rectangular prism with the broad flat bottom 57 illustrated in FIG. 5. Accordingly, the solution proposed by the present disclosure involves creating the closed bottom with a seam that is shorter, and preferably considerably shorter, than the open end relaxed width. To accomplish this, once the 'tube' is created by stitching the side edges, FIG. 1 proposes grouping and gathering the bottom edge into a straight seam that is significantly shorter than the open end relaxed width, and then stitching it to create the shortened gathered seam 32A. Now, as illustrated in FIG. 13, a neat appearance is provided at the closed end 30B, and gathers 33 from the shortened gathered seam 32A naturally spread out across the broad flat bottom 57 of the gift packaging contained therein. Note that with the substantial uniformity of the tube, the main part extends neatly up the sides of the gift packaging—the gathers 33 are confined to the bottom 57 in the area surrounding the shortened gathered seam 32.

Figure 11:
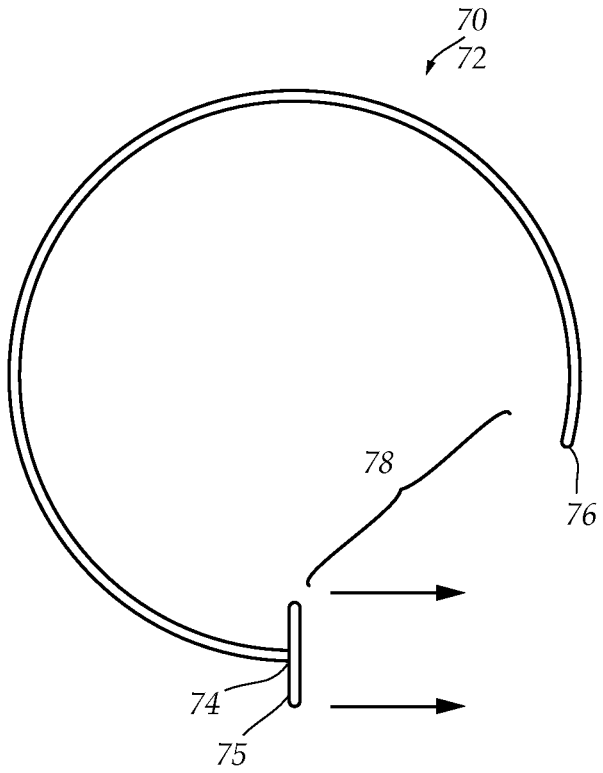
FIG. 11 illustrates a resilient, open ring that may be used to create the ring gathered stitch.

Alternatively, to accomplish the shorter relaxed width at the closed bottom 30B, the ring gathered seam 34 is created. In particular, once the side edges 31S are stitched into a tube, the ring gathered seam 34 allows the bottom edge 31B of the sheet 31 (as shown in FIG. 9) to be brought together into a small ring configuration. This can be accomplished using a circular gathering device 70, such as the open ring 72 illustrated in FIG. 11. The open ring 72 is generally circular in shape, having a stop end 74 and a free end 76. The open ring 72 is preferably made of a stiff but flexible material, such as metal wire, so that in its relaxed state the stop end and free end substantially touch to complete its circular shape, and so that it can be flexed, as illustrated to create a wide gap 78 between the stop end 74 and free end 76, and will return the stop end 74 toward the free end 76 and thereby reduce the gap 78 when released. Note that the stop end 74 may include a transverse T-portion 75 for advantages that will become clear shortly.

Returning to FIG. 9, for creation of the embodiment of main part 30 shown in FIG. 2, the top edge 31T has been folded over and stitched to create a pocket 80, which is a channel that extends fully between the sides 31S. The pocket 80 has a first opening 801 at one of the sides 31S and a second opening 31S at the other of the sides 31S, and is continuous therebetween. Note that the size of the pocket 80 is greatly exaggerated in FIG. 9 (perhaps by a factor of at least ten). The pocket 80 need only be small fold in the fabric—just large enough to allow the circular gathering device 70 to be inserted fully therethrough from the first opening 801 to the second opening 802.

Figure 10:
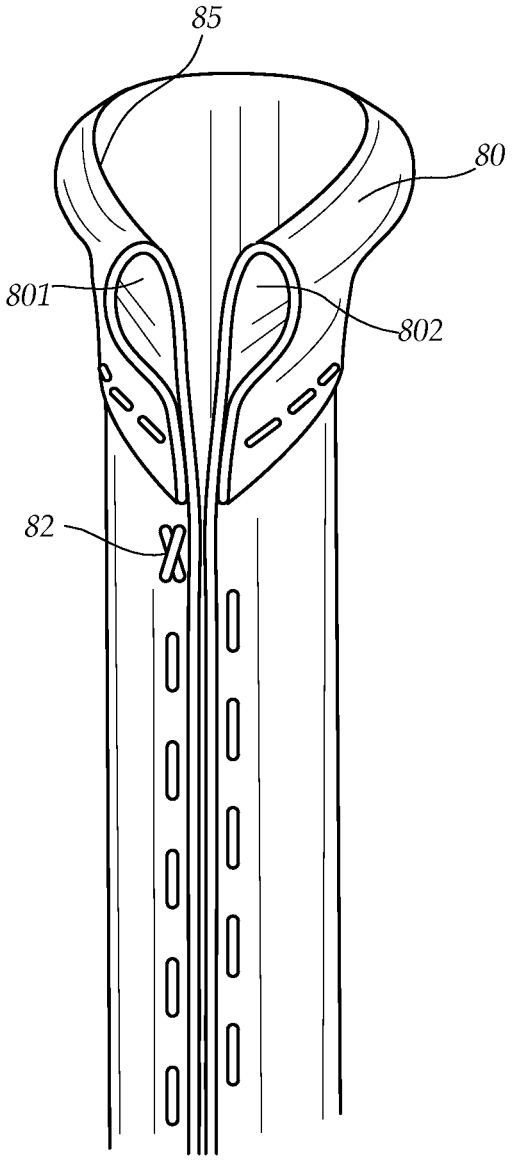
FIG. 10 illustrates a next fabrication step, performed with the arrangement of FIG. 9, where opposite edges are brought together, stitched together up to the pocket and then lock stitched, leaving the pocket openings adjacent to each other.

Referring to FIG. 10, after the pocket 80 is created, the sides 31S are stitched together to create the 'tube'. In particular, the sides are stitched together from the bottom edge of the fabric sheet (not shown), until just below the pocket 80, where a lock stitch 82 is made. This is done because it is desirable to not close the channel, but instead leave the first opening 801 and second opening 802 accessible. Note that once the stitching is completed, the first opening 801 and second opening 802 are immediately adjacent to each other, and the main part 30 is still open at its bottom. Note that if said bottom were gently arranged into a circle without stretching it, one would observe a relaxed diameter 85 there that is related to the open end relaxed and formed into a circle. Also as previously discussed, the goal is to close the bottom with a seam that is much smaller than the open end relaxed width, while maintaining a general uniform width through most of the tube. In fact, at the lock stitch 82, the tube would have the same relaxed width at the top edge 31T (not seen in FIG. 10). Before describing in detail how the bottom is closed with the ring gathered seam, it should be noted that the ordering of the steps that create the tube and that create the pocket can be reversed, provided care is taken when making the tube to ensure that the pocket can still be created as desired, with its openings 801 and 802 adjacent to each other.

Figure 12:
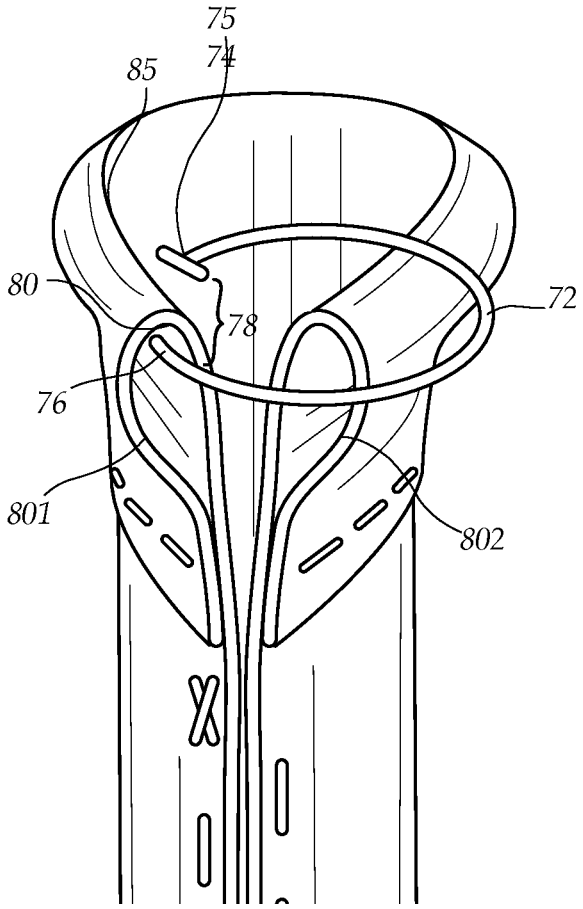
FIG. 12 illustrates a free end of the open ring being inserted into one of the pocket openings to begin gathering the pocket around the ring.
Figure 14:
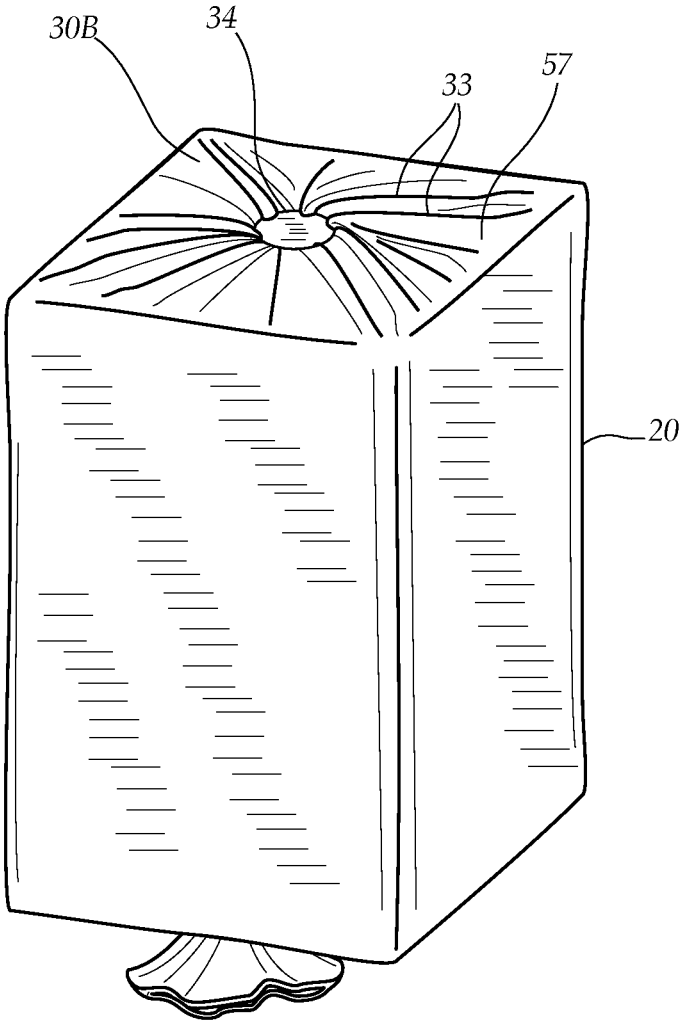
FIG. 14 illustrates the wrapped gift with the ring gathered stitch at the closed end, wherein a starburst pattern is created therearound. Note that the size/diameter of the ring is exaggerated in the drawing figure for clarity of illustration.

FIG. 12 illustrates a next step in creating the ring gathered seam 34 using the open ring 72. In particular, open ring 72 is flexed to widen the gap 78, so that the free end 76 is inserted into the first opening 801 of the pocket 80. Note that the ring has a diameter that is much smaller than the relaxed diameter at the bottom. For example, if the relaxed diameter of the were approximately five to ten inches, the diameter of the ring might be approximately ½ to 1½ inches. Thus, as the ring is 'worked' through the pocket 80, the fabric will bunch up significantly and gather around the ring into a tight circle. When the open ring 72 is worked fully through the pocket 80, the free end 76 will substantially reach the second opening 802 and the stop end 74 will reach the first opening 801, and preferably be stopped from extending further by the transverse T-portion 75 meeting and interfering with the first opening 801 and thereby preventing the ring 72 from extending further through the pocket 80. When the ring is released, the ring will hold the fabric securely into the circular configuration of the ring gathered seam 34. Note that the ring gathered seam 34 may be further secured by stitching therealong, but once the fabric is gathered around the open ring, it will create its own tension, and is unlikely to move even if not stitched. In any case, the ring gathered seam 34 provides a tight and permanent gathering at the closed end 30B. "Permanent", as used herein, indicates that the gathering is done during manufacturing—prior to providing the device 30 to the consumer, and the ring gathered seam is intended to remain in place throughout the normal usage by the consumer. With the configuration of the present disclosure, the consumer is not intended to tamper with, open, or operate the ring gathered seam. Now, as illustrated in FIG. 14, a neat appearance is provided at the closed end 30B, and gathers 33 from the ring gathered seam 34 naturally spread out across the broad flat bottom 57 of the gift packaging contained therein in a radial, starburst pattern than is particularly aesthetically pleasing and thereby provides an additional benefit for fabricating the main part 20 using the ring gathered seam 34. Considering that the tube is actually of consistent width except at the ring gathered seam 34, the starburst pattern will propagate across the broad flat bottom 57 but will not extend beyond the edges 54 thereof. Note that following any of these fabrication techniques, the main part 30 would likely be turned inside-out, to conceal all sewing and rough fabric edges within the interior of the main part.

Figure 3:
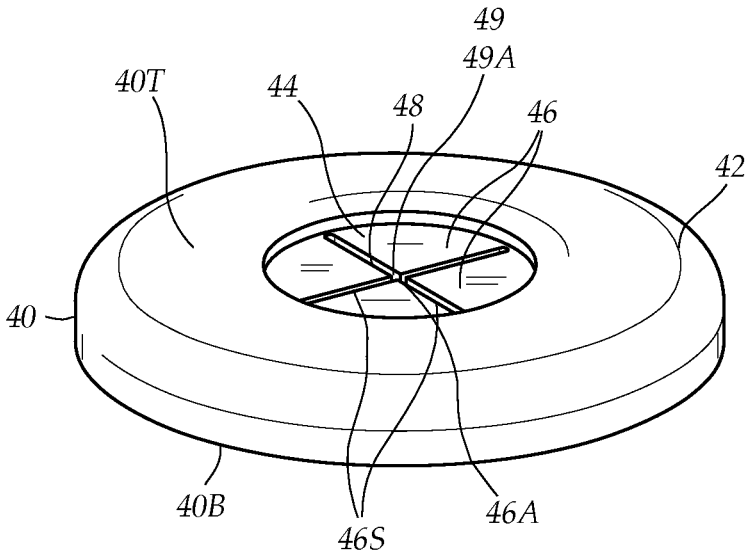
FIG. 3 is a diagrammatic perspective view, illustrating a closure plate of the wrapping device, per se.
Figure 4:
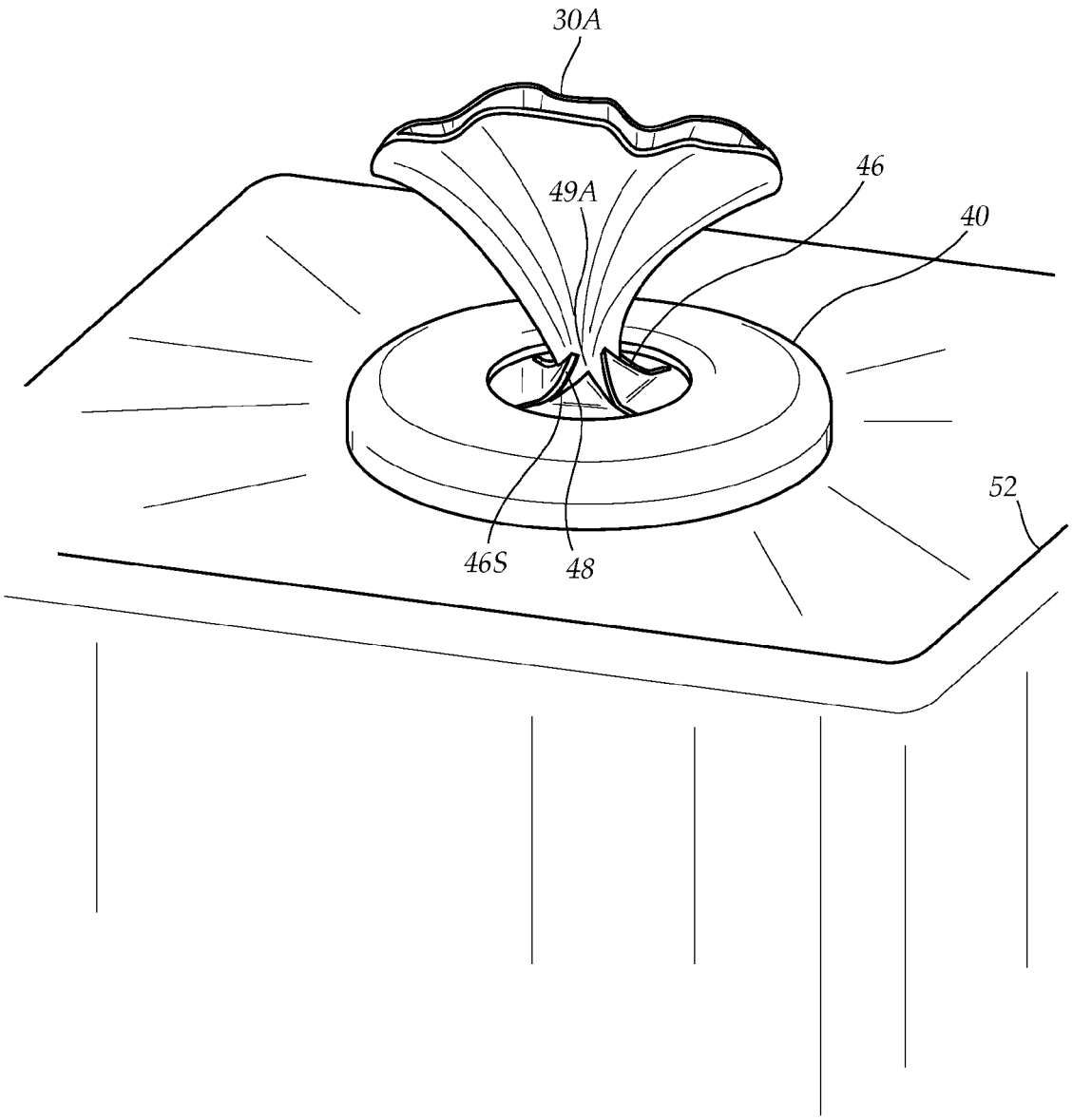
FIG. 4 is a diagrammatic perspective view, illustrating a gift fully wrapped with the main part, with the closure plate pulled down upon the open end.

Referring now to FIG. 3, the closure plate 40 is illustrated, per se. In particular, the closure plate 40 has a top surface 40T, a bottom surface 40B, an outer frame 42, and a central part 44. The closure plate 40 is preferably made and plastic, may be circular in shape, and is shaped and of a suitable thickness to be substantially rigid so that it can be handled with significant force. The central part 44 may also be made of the same plastic, and in fact fabricated as one piece with the outer frame 42, yet the central part 44 is substantially thinner so that it is quite flexible. With the addition of radial slits 48, generally crossing in the shape of an "X", the central part has a plurality of flaps 46 that are normally co-planar (when un-flexed) but may easily flex upwardly or downwardly, whereupon a spring force creates a desire for them to return to their co-planar state. The flaps 46 are thereby created and defined by the radial slits 48, which extend fully between the top 40T and bottom 40B and generally cross each other, such that the flaps 46 meet and are oriented toward a center point 49. Note that the center point 49 may be an actual point, or may be a general location where the slits 48 are substantially oriented towards. Note that the flexible nature of the flaps 46 and the presence of slits 48 therebetween allows the center point 49 to be and expand a central opening 49A that expands as the flaps 46 are flexed in the same direction. The flaps 46 each thereby have side edges 46S and an apex 46A. Referring to FIG. 4, it is this flexible nature of the flaps that allows the central opening 49A of the closure plate 40 to effectively open to allow passage of the open end 30A of the main part 30, through the central opening and through the slits 48, such that the side edges 46S and apexes 46A of the flaps 46 bite into the main part 30 to hold it in place on the gift packaging 52.

Figure 6:
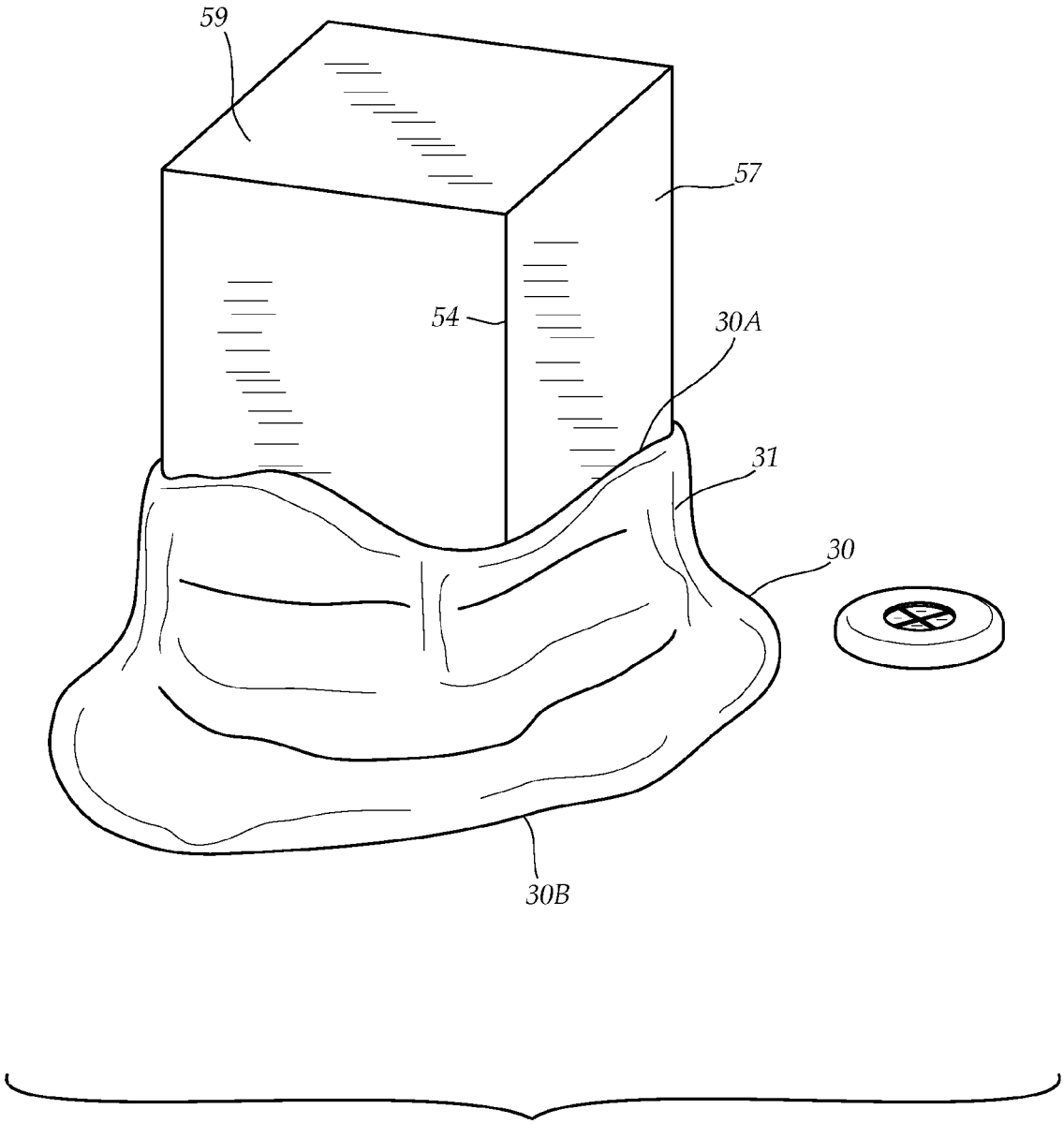
FIG. 6 illustrates the gift being wrapped, wherein the open end has been stretched partially over the gift packaging and is being urged toward the closed end.

Illustrating how the gift wrapping device 20 is used to wrap and conceal gift 50 contained within gift packaging 52, reference is made once again to FIG. 5. The open end 30A is manually spread and stretched so that it can be extended around all edges 54 of the bottom 57 of the gift packaging 52. Once the bottom 57 is enveloped within the open end 30A, the open end is pulled upwardly on the gift packaging 52 toward the top 59 as the gift packaging 52 is pushed downwardly toward the closed end 30B, as indicated in FIG. 6. Note that for illustrative purposes, the drawing figures show more 'slack' in the fabric 31 than would actually be present when stretching the main part 30 upwardly. In reality, the main part 30 would already be tightly conforming to the shape of the gift packaging 52, showing every edge 54, as the main part 30 is pulled upwardly thereupon.

Figure 7:
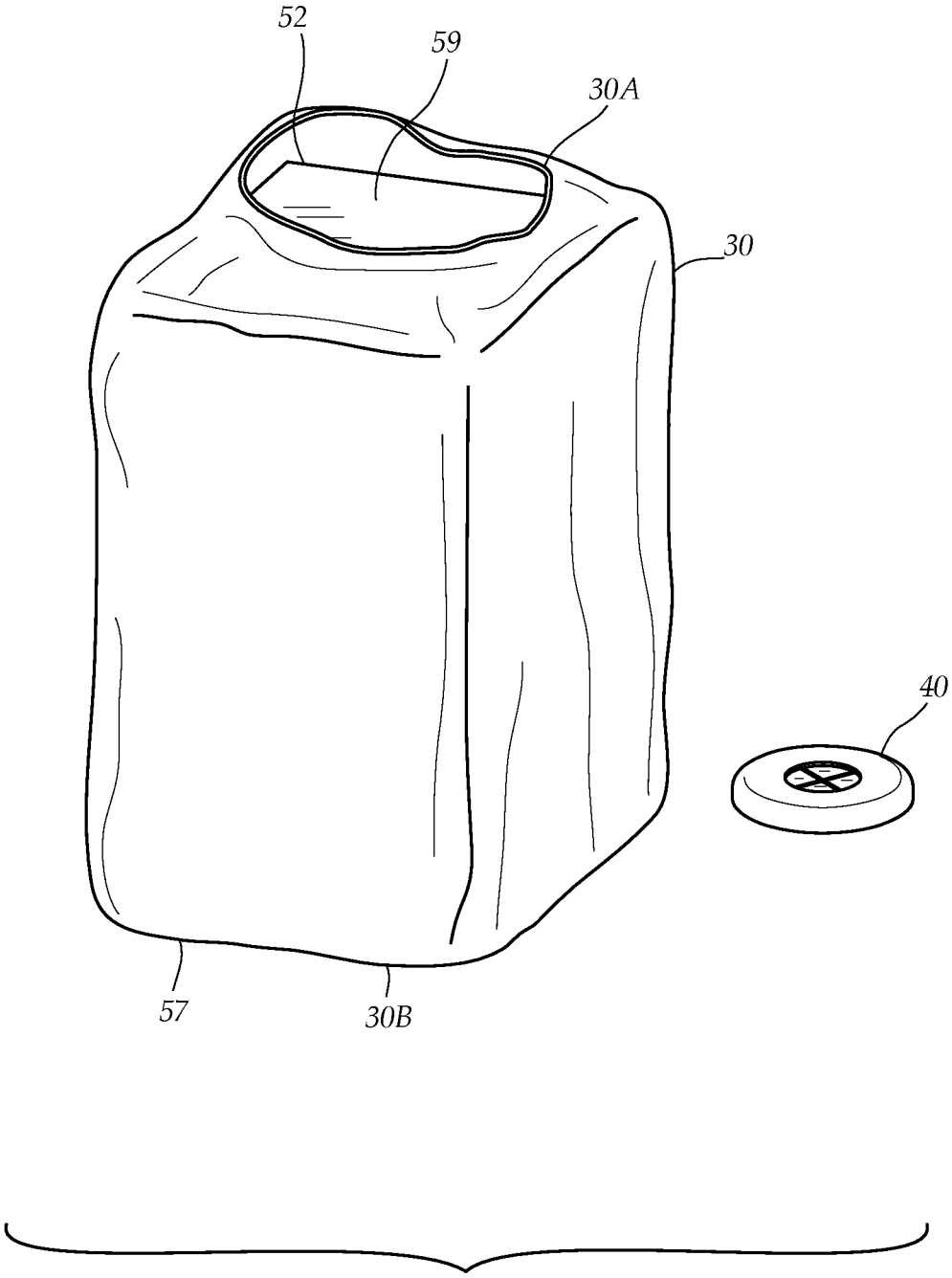
FIG. 7 is a diagrammatic perspective view, similar to FIG. 6, wherein the gift packaging has been pulled almost fully toward the closed end.
Figure 8:
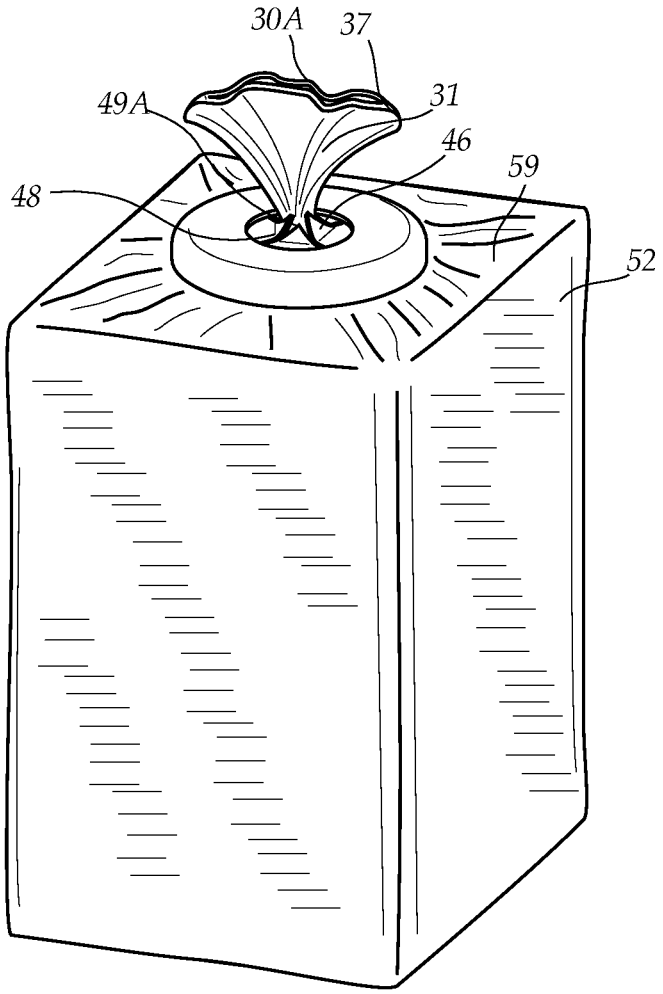
FIG. 8 illustrates a final step in the gift wrapping process, wherein the gift packaging has been pulled fully toward the closed end, the free end has been inserted through the central opening of the closure plate, and the closure plate has been pulled down flush against the gift as the free end has been pulled upwardly.

In FIG. 7, the main part 30 has been stretched nearly fully over the gift packaging 52, wherein the open end 30A has cleared the top 59. At this point, what remains is to pull the gift packaging 57 as tightly over the packaging 52 as possible with the bottom 59 of the packaging 52 tightly against the closed end 30B—substantially removing all wrinkles—and manually gather the free end 30A into a tail 37 (as seen in FIG. 8), readying it for the closure plate 40. Referring now to FIG. 8, the tail 37 has been pulled upwardly through the central opening 49A of the closure plate 40, and the closure plate 40 has been pushed downwardly against the top 59 of the gift packaging 52. As the tail 37 was pulled upwardly, the flaps 46 flexed and allowed the fabric 31 of the tail 37 to spread into the slits 48. With the fabric 31 spread into the slits 48, and with the tendency of the flaps 47 to return to their co-planar, un-flexed position, significant mechanical interaction is created between the fabric 31 and the closure plate 40. In particular the fabric 31 getting pinched between the side edges 46S and stuck at the apexes 36A effectively maintains the closure plate 40 in position and keeps the gift wrapped and concealed until it is desired to unwrap and un-conceal it. With the wrapping device fully installed, inverted views FIG. 13 and FIG. 14 illustrate the manner in which it stretches and conforms to all edges the seams 32, 34 provide a neat appearance fully opposite from the tail 37. Note that the unruliness of the gathers 33 are somewhat exaggerated in the drawing figures for illustrative purposes, but actually are quite orderly around the shortened gathered seam 32, and in the starburst pattern around the ring gathered seam 34, created when the main part is pulled tightly upwardly against the bottom 57 of the gift packaging 52. Note that gifts wrapped in this manner are extremely stable, and not at all fragile—meaning they can be stacked and transported without wrinkling or damaging the wrapping device.

To unwrap the gift, one need only give a firm upward tug on the closure plate 40 while holding the gift packaging 52, and the flaps 46 will flex sufficiently to allow the closure plate 40 to be pulled once again free of the tail 37. At that point, the open end may be stretched around the edges of the gift packaging, and removed therefrom, similar to the way a sock, stockings, or tights are removed by their wearer. Once the main part 20 is free of the gift packaging 57, the gift is revealed to the recipient, and the gift wrapping device 30 may be reused by the recipient to wrap another gift. In fact, the gift wrapping device 30 experiences very little wear from each use, and may be reused many times.

In conclusion, herein is presented a gift wrapping device which may be used to wrap and conceal a gift of virtually any shape, effectively conforming to the shape of the gift with virtually no wrinkles, bunches, or gaps, which may easily be deployed and removed, and which may be reused many times. The invention is illustrated by example in the drawing figures, and throughout the written description. It should be understood that numerous variations are possible, while adhering to the inventive concept. Such variations are contemplated as being a part of the present disclosure.

What is claimed is:

1. A gift wrapping device, for use wrapping a gift contained in gift packaging having a top and a bottom, comprising:

a main part made of a highly stretchable, conformable, and substantially rectangular sheet of fabric, the sheet of fabric having a top edge, a bottom, and side edges, the side edges stitched together to form a tube that remains open at an open end having an open end relaxed width, and that is closed at a closed end formed by gathering the bottom edge, the bottom edge formed into a pocket extending fully therealong, the pocket having a circular gathering device that is much smaller in diameter than the open end relaxed width, the circular gathering device configured for extending fully through the pocket to allow the pocket to permanently gather and bunch around said circular gathering device in a circular, ring gathered seam that is smaller than the open end relaxed width and which permanently closes the closed end, such that near the closed end, the tube is somewhat tapered toward the closed end, and wherein once the gift has been fully inserted into the open end with its bottom against the closed end, the open end may be gathered to form a tail just above the top of the gift packaging; and a closure plate, having a top surface, a bottom surface and a central opening, the central opening allows the tail to be inserted and pulled upwardly therethough as the closure plate is pressed downwardly so that the bottom surface of the closure plate may rest against the top of the gift packaging, the closure plate also having a plurality of flaps arranged around the central opening, the flaps separated by slits, each flap having side edges and an apex, the flaps flexing and the slits opening to enable the central opening to expand as the tail is inserted and pulled therethrough, the fabric spreading into the slits and interfering with the side edges and the apex to help maintain the closure plate in position on top of the gift packaging.

2. The gift wrapping device as recited in claim 1, wherein the circular gathering device is an open ring having a free end and a stop end, the open ring is made of a material that is generally circular in shape and stiff but which may be manually flexed to create a wide opening between the free end and stopped end, so that the free end can be inserted into the pocket and extended through the pocket as the fabric is gathered around the pocket until the ring is fully inserted into the pocket to the stop end, and the ring is released and allowed to return to its circular shape, holding the circular shape of the ring gathered seam.

3. The gift wrapping device of claim 2, wherein the pocket has a first opening and a second opening, the first and second openings are adjacent to each other when the side edges of the fabric sheet are joined, wherein the open ring has a transverse-T at the stop end, such that the free end may be inserted into the first opening of the pocket and brought through the pocket toward the second opening until the transverse-T meets and interferes with the first opening and the ring is prevented from moving further through the pocket thereby.

4. A gift wrapping device, for use wrapping a gift contained in gift packaging having a top and a bottom, comprising:

a main part made of highly stretchable and conformable fabric initially in a substantially rectangular configuration having a top edge, a bottom edge, and side edges, the side edges are joined together to form a tube that is closed at a closed end, and remains open at an open end, the open end having an open end relaxed width configured to be manually gathered to form a tail just above the top of the gift packaging once the gift has been inserted into the open end with its bottom against the closed end, the closed end having a closed end relaxed width that is much smaller than the open end relaxed width, and wherein the bottom edge of the fabric is formed into a pocket extending fully therealong, the pocket having a first opening and a second opening, the first opening and the second opening adjacent to each other, and a circular gathering device much smaller in diameter than the open end relaxed width, the circular gathering device extended fully through the pocket to allow the pocket to permanently gather and bunch around said circular gathering device into a ring gathered seam, permanently closing the closed end, and tapering the tube somewhat toward the closed end, immediately adjacent to the closed end; and wherein the device as recited further includes a closure plate, having a top surface, a bottom surface a central opening, and a plurality of flaps arranged around the central opening to allow the central opening to expand, wherein the flaps are separated by slits, each flap having side edges and an apex, so that as the central opening allows the tail to be inserted and pulled therethrough, the flaps flex and the slits open to allow the fabric to spread into the slits and then interfere with the side edges and the apex to help maintain the bottom surface of the closure plate in position against the top of the gift packaging.

5. The gift wrapping device as recited in claim 4, wherein the circular gathering device is an open ring, made of a material that is generally stiff but which may be manually flexed, the open is generally circular in shape when unflexed, having a free end and a stop end, the ring may be flexed to create a wide opening between the free end and stopped end, so that the free end can be inserted into the pocket and extended through the pocket as the fabric is gathered around the pocket until the ring is fully inserted into the pocket to the stop end, and the ring is released and allowed to return to its circular shape, holding the circular shape of the ring gathered seam.

6. The gift wrapping device of claim 5, wherein the open ring has a transverse-T at the stop end, and wherein the free end may be inserted into the first opening of the pocket and brought through the pocket toward the second opening until the transverse-T meets and interferes with the first opening and the ring is prevented from moving further through the pocket thereby.

* * * * *